US005716196A

United States Patent [19]

Castel

[11] Patent Number: 5,716,196

[45] Date of Patent: Feb. 10, 1998

[54] PUMPING METHOD AND DEVICE WITH SEQUENTIAL JETS

[75] Inventor: Yvon Castel, Croissy sur Seine, France

[73] Assignee: Institut Francais du Petrole, Rueil Malmaison, France

[21] Appl. No.: 753,958

[22] Filed: Dec. 3, 1996

Related U.S. Application Data

[62] Division of Ser. No. 498,393, Jul. 5, 1995, Pat. No. 5,616,006.

[30] Foreign Application Priority Data

Jul. 5, 1994 [FR] France ..... 94 08379

[51] Int. Cl.[6] ..... F04F 5/10

[52] U.S. Cl. ..... 417/178

[58] Field of Search ..... 417/194, 178

[56] References Cited

U.S. PATENT DOCUMENTS 2,623,474 12/1952 Friedman ..... 417/178

3,450,051 6/1969 Anthon ..... 417/178 X

FOREIGN PATENT DOCUMENTS 1521928 11/1989 U.S.S.R. ..... 417/178

*Primary Examiner*—Richard E. Gluck

*Attorney, Agent, or Firm*—Antonelli, Terry, Stout, & Kraus, LLP

[57] ABSTRACT

Pumping method by direct energy exchange during which a drive fluid is sent intermittently in the form of one or more jets into a primary fluid.

Pumping device comprising a hollow part (2) and a distributing part, each provided with orifices (Oi) and (Ei). A rotationally movable part (6) is interposed between the hollow part and the distributing part, and fitted with a blocking means in order to generate Jets of drive fluid intermittently toward a fluid to be transported.

10 Claims, 6 Drawing Sheets

PUMPING METHOD AND DEVICE WITH SEQUENTIAL JETS

This application is a Divisional application of application Ser. No. 498,393, filed Jul. 5, 1995, now U.S. Pat. No. 5,616,006.

FIELD OF THE INVENTION

The present invention relates to a device for enhancing the pumping and thrust performance of devices in which a drive fluid is induced in a primary fluid to be transported so as to transfer a certain quantity of energy to the latter.

The device according to the invention has advantageous applications in oil production for transferring a petroleum effluent such as heavy crudes gasified and laden with solid particles such as sand or hydrates. It is also suitable for viscous fluids or products that are gasified and contain abrasive particles or have an aggressive nature, such as $H_2S$, $CO_2$, and brines encountered in the majority of petroleum-type effluents.

Advantageously, the devices according to the present invention are particularly suitable for operation of offshore wells and prove to be easier than the seabed electric pump pumping technique currently in use.

BACKGROUND OF THE INVENTION

Direct energy transfer from a drive fluid to a primary fluid to be transported is described in the prior art.

Thus, U.S. Pat. No. 3,046,732 and U.S. Pat. No. 4,485,518 describe devices and methods wherein momentum and energy are transferred from a first fluid to a second fluid.

The teaching contained in U.S. Pat. No. 3,046,732 has the principal goal of minimizing shear effects created in the primary fluid to be pumped that may appear at the interfaces between the fluid and the mechanical parts of the device. For this purpose, the invention consists of separating the drive fluid into two parts, ejecting a first part of this fluid through orifices located on a rotor into a primary fluid, and using the fluid jet resulting from the second part of the drive fluid passing through a central orifice to drive the first part of the drive fluid and the primary fluid. Thus, the shear that might appear between a fluid and a mechanical part is minimized. The drive fluid jets are emitted continuously through ejection orifices.

The problems generated by contact between particles and mechanical parts of the device may lead to decreased reliability of the device and more frequent servicing to replace parts.

U.S. Pat. No. 4,485,518 teaches ejecting a drive fluid in the form of jets through orifices and grooves located on the outside wall of a rotating part, said part being positioned inside a pipe in which a primary fluid to be pumped circulates. The drive fluid jets emerging when this part rotates transfer their energy tangentially to the primary fluid, and it is this tangentiality that may cause an imbalance in energy transfer.

The use of devices utilizing the energy supplied by jets for propulsion in the shipbuilding or aerospace industries is also known.

Jet energy is also utilized in classical jet pumps described for example in Patent FR-2,617,245 by the applicant. Such devices emit a continuous high-speed axial jet which, by shear at the periphery, entrains the fluid to be transported and leads to lowered efficiency in energy utilization. Moreover, such pumps can present problems such as lowered intake pressure causing substantial degassing, cavitation phenomena, and wear at the nozzles due to the high fluid speeds and the possible presence of solid particles in the fluids with which they are in contact. These drawbacks impair the efficiency of these devices. Moreover, the regulation of such pumps to operate optimally requires knowledge of the values of parameters that are often variable and difficult to measure.

Thus, existing devices do not allow simultaneous generation of a variable-frequency variable-length intermittent axial Jet and an axial or annular rotating layer of fluid, said Jets having an effect identical to the effect obtained by the mechanical type of piston normally used while avoiding the drawbacks associated with the latter, particularly problems when mechanical parts rotate with respect to each other and wear out.

SUMMARY OF THE INVENTION

The goal of the invention is to improve pumping efficiency using energy transfer from one drive fluid to another fluid. It also enables the lifetime of the mechanical parts rotating with respect to each other to be increased, particularly by removing these parts from contact with fluids containing heterogeneities such as particles.

Thus, the present invention relates to a method and a simple, sturdy, and reliable machine, which are designed in particular to transfer fluid such as a viscous fluid that is difficult to entrain or which by its nature requires substantial forces and energies to cause the various parts to rotate with respect to each other.

The present invention relates to a method allowing energy to be communicated directly from a drive fluid to a primary fluid to be pumped. It is characterized by production of at least one fluid jet from a static distributing part comprising at least one orifice and causing a movable part having at least one means of blocking said orifices to rotate, said movable part being in contact only with said heterogeneity-free drive fluid such that said fluid jet or jets is/are sent intermittently.

Drive fluid jets can be sent sequentially in order to generate intermittent fluid "pistons" of specific lengths at given time intervals.

For example, fluid pistons are sent at identical time intervals.

According to one embodiment, the fluid jets are produced for example by means of orifices having a geometry designed such that the fluid pistons generated have identical lengths.

For a primary fluid flowing in a pipe, the drive fluid can be sent in such a way as to generate several fluid pistons distributed in space in order to generate a fluid thrust having substantially the shape of a spiral, or being substantially helical.

The present invention also relates to a pumping device employing direct energy exchange between a drive fluid and a primary fluid. It has for example, in combination, a static hollow part allowing said drive fluid to pass, said static hollow part having at at least one of its ends at least one orifice Oi, a distributing part having at least one orifice Ei, said distributing part being situated with respect to the static hollow part such as to allow the drive fluid to pass from one orifice Oi to an orifice Ei, the distributing part and the static part being joined for example by a connecting and sealing part, a movable part disposed in the space formed by the static hollow part, the distributing part, and the connecting part, said movable part having at least one means for blocking orifices Ei such that at least part of said drive fluid is ejected intermittently toward the primary fluid when the movable part rotates.

The movable part can be a turbine made to rotate by the drive fluid.

The number of orifices Oi located on the static hollow part can be equal to the number of orifices Ei located on the distributing part.

It has, for example, a part located in the extension of the distributing part and aligned with the latter with the aid of means, the part having at least one opening creating a mixing space.

The movable part is for example an action turbine or a reaction turbine caused to rotate by the drive fluid.

The orifices of the distributing part are for example composed of a single circular slot and the blocking means of the slot can be composed of a slide designed to allow passage of the drive fluid jets over a given width.

The distributing part is for example extended by a part whose shape is designed to create one or more mixing spaces.

The method and the device can be used to communicate energy from a drive fluid to a primary fluid such as a high-viscosity multiphase fluid, or to a multiphase fluid containing solid particles, or to a petroleum effluent.

Minimizing the number of mechanical parts normally used in classical pumping devices, particularly by replacing the mechanical blades of positive displacement pumps or rotodynamic pumps by fluid blades increases the reliability of the device and reduces problems arising from mechanical parts.

The sequencing system of the device offers in particular the advantage that no movable parts are in contact with the pumped effluents that having varying degrees of aggressiveness. In the device, the movable parts are in contact with a medium believed to be clean, thus conferring on the device a longer lifetime than the lifetimes of the devices normally used in the prior art.

The energy required for the sequential blocking function of the orifices allowing the drive fluid to pass is low.

By using a fluid bearing between the parts that rotate with respect to each other, it is possible to cut down on wear occurring at the axis of rotation of the movable part.

BRIEF DESCRIPTION OF THE DRAWINGS

The present invention will be better understood and its advantages will emerge clearly by reading several nonlimiting examples illustrated by the following figures among which.

DETAILED DESCRIPTION OF THE INVENTION

Figure 1A:
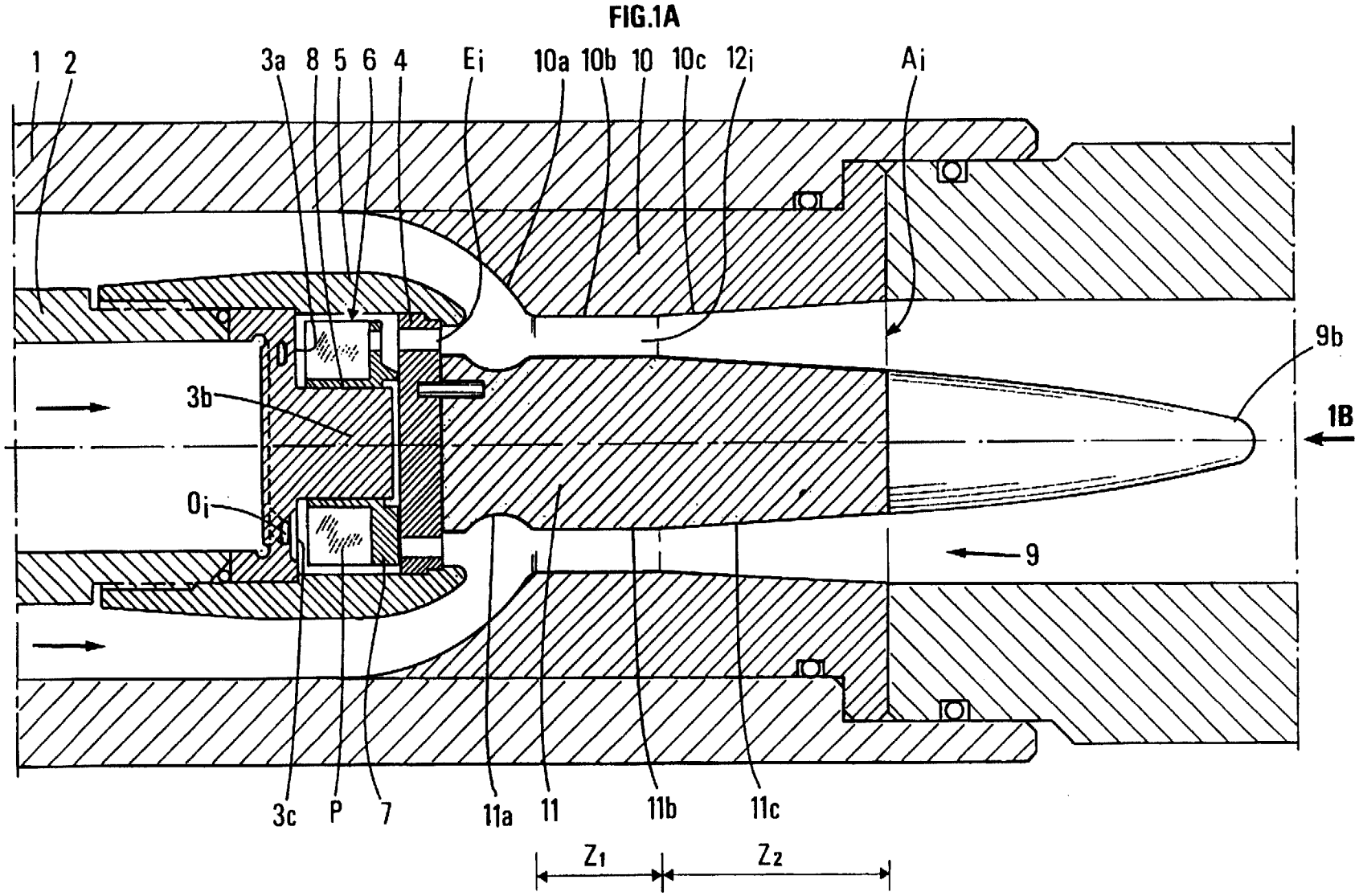
FIGS. 1A, 1B, 1C, and 1D show schematically a device according to the invention delivering intermittent drive fluid jets or liquid pistons and an example of the sequencing of these jets.

The embodiments of the device described with reference to FIGS. 1A to 4 relates to several variants of a device for pumping a fluid, for example a fluid of the multiphase type including solid particles, or a primary fluid to be pumped or transferred over a given distance to which part of the energy possessed by a drive fluid is directly transferred.

For example, jets are generated intermittently in space or in time or in the form of axial or annual rotating fluid layers.

The pumping device of FIG. 1 is inserted for example into a pipe 1 in which the primary fluid or multiphase fluid is circulating, coming for example from an oil well not shown in the figure.

It has a static hollow part 2 which communicates with a source of drive fluid under pressure, such as a pressurized liquid. One of the ends of part 2 is T-shaped for example, comprising in succession a part 3*a*, an and 3*b*, and another part 3*c*. Parts 3*a* and 3*c* have for example orifices Oi which allow the drive fluid to pass from the inside of static hollow part 2 to a distributing part 4 having for example several openings or orifices Ei. Distributing part 4 is located substantially in the axis of static hollow part 2 and is held by a connecting part 5, the latter also providing a seal between the various parts so that the primary fluid that may contain impurities flows solely or practically totally in pipe 1. In this way, passage of primary fluid into the space formed by static hollow part 2, distributing part 4, and connecting part 5 is prevented, and contact of impurities with the movable parts of the device described hereinbelow is prevented. A movable part 6 such as an action turbine is positioned between static hollow part 2 and distributing part 4; in this way it is in contact only with the drive fluid because of the seal provided by connecting part 5, and hence with a liquid free of impurities or containing only a tiny proportion thereof. The turbine is for example rotationally movable around part 3*b* of part 2 on bearings 8. The turbine can be fitted with blades P serving to support at least one means for blocking orifices Ei, for example a slide 7. When the turbine rotates under the action of the drive fluid, slide 7 sequentially blocks orifices Ei, which generates drive fluid jets, such as fluid or liquid pistons, which encounter the primary fluid to be pumped and propel it, imparting thereto at least some of the energy they contain. The encounter between the primary fluid and the liquid pistons occurs, for example, downstream of orifices Ei or as they exit the orifices.

The mixture formed by the liquid pistons and the primary fluid is then transferred, for example, to a processing station via a transfer pipe, or to an extension pipe.

The speeds of the primary fluid and the liquid pistons are such that the probability of primary fluid returning through orifices Ei to the space in which the movable part is located is minimized or even eliminated. In this way, it is practically impossible for impurities to encounter the rotating turbine. The speed of a liquid piston is for example far higher than that of the primary fluid, being for example approximately 100 m/s.

In order to favor mixing of the liquid piston and the primary fluid, orifices Oi are advantageously placed at an angle.

The turbine equipped with the slide can also be made to rotate by a device not shown which allows the rotational speed to be varied.

The rotational speed is chosen for example as a function of the desired frequency with which the fluid pistons or liquid pistons formed by passage of jets of drive fluid are sent through orifices Ei.

The geometry of orifices Ei, namely their shapes and sizes, establishes for example the ratio between the active length of the liquid piston injected and the total length or total duration of the piston production cycle.

In order to improve energy transfer between a liquid piston coming from an orifice Ei and the primary fluid, it is possible to place, in the extension of distributing part 4, a part 9 designed to delimit at least one channel (FIGS. 1A and 1B) in which the mixing of the primary fluid and liquid piston is almost total. A channel 12*i* has for example a first part and a second part that have a first length Z1 and a second length Z2, respectively. The first part or mixer has an essentially constant cross section over the majority of its length Z1 and the second part or diffuser has a section that tapers in the direction away from the distributing part over at least a majority of its length Z2. Part 9 is for example positioned relative to distributing part 4 with the aid of an alignment finger known to the individual skilled in the art. Channels 12*i* have in particular the function of guiding the encounter of a liquid piston with at least part of the primary fluid, and favoring their encounter and mixing. The speed energy acquired in mixing channel 12*i* becomes converted into pressure energy in the diffuser. Part 9 also has orifices Ai whose number is for example equal to that of orifices Ei, which allow jets coming from channels 12*i* to be transferred to a transfer pipe.

The center part of part 9 can be extended by a part 9*b* such that a nose penetrating into the transfer pipe located for example on the extension of channel 1, so that passage of the mix of fluids circulating in channels 12*i* to the transfer pipe occurs without the flows being disturbed.

The shape of a channel 12*i* results for example from a part 9 having for example an inside wall having a part 10, composed of a first incurred zone 10*a* followed by a second zone 10*b* with for example a length Z1 extended by a third zone 10*c* substantially at an angle to the axis of the pipe which has a length Z2 for example, a central part 11, for example cylindrical or slightly conical, having incurved zones 11*a* located opposite incurred zones 10*a* thus forming a space in which a liquid piston encounters a primary fluid, the space being located downstream from orifices Ei. The first zone 11*a* of part 11 is extended for example by a second zone 11*b* whose length is substantially identical to length Z1 and a third zone 11*c* extending second zone 11*b* and having a length substantially equal to length Z2.

The aperture angle obtained at the outlet of a mixing channel 12*i* as defined above is for example equal to 7°.

Another embodiment according to the invention consists of creating a single mixing channel such as an annular mixing space. Central part 9 has, in this case, a circular slot and is rendered integral with distributing part 4 by means such as arms whose size results from a compromise minimizing mixing impacts on these arms and withstanding high pressures of the mixture formed by the drive fluid and the entrained multiphase fluid.

Various fluid piston generating sequences can be envisaged. In order better to understand the method according to the invention, FIGS. 1C and 1D, for illustrative and non-limiting purposes, describe one example of a cycle and the geometry of orifices Ei of the associated distributing part.

The distributing part has for example two orifices E1 and E2 (FIG. 1D) which are positioned for example at 180° to each other, and have substantially identical geometries. The fluid pistons created by sequential blocking of orifices Ei in fact have substantially identical lengths.

Figure 1B:
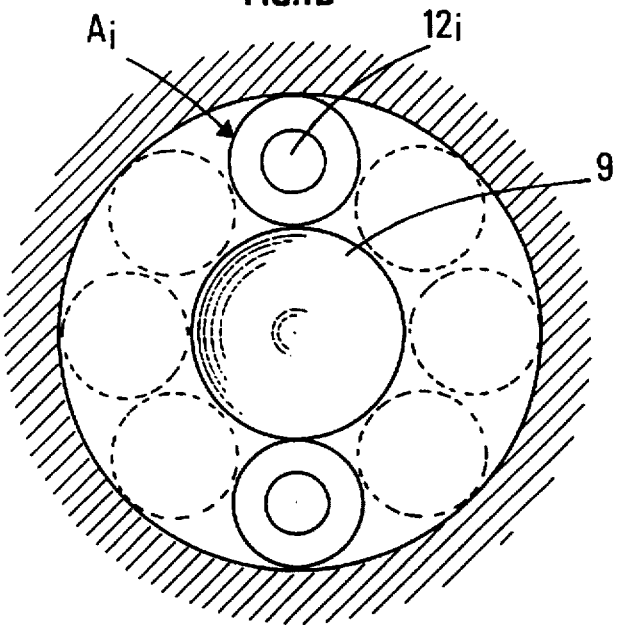
Figure 1C:
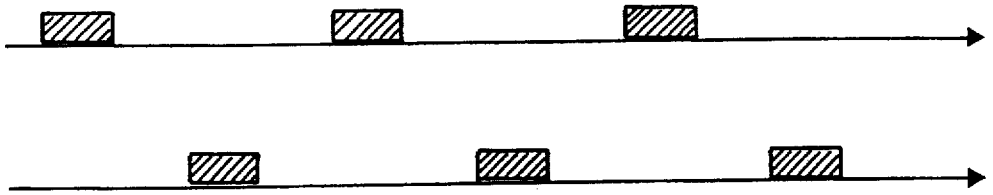
Figure 1D:
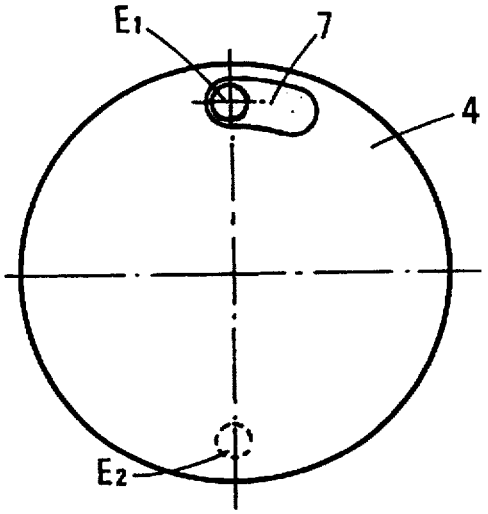

FIG. 1C shows on two time axes the series of fluid pistons P1 and P2 passing through orifices E1 and E2 respectively.

When the turbine is rotating, the slide blocks orifice E2 for example, allowing drive fluid to pass through orifice E1, thus creating a first fluid piston P1, then as the rotational movement continues it blocks orifice E1, thus creating the second fluid piston, with the majority of the drive fluid passing only through orifice E2. This production sequence of fluid pistons P1 and P2 repeats as the turbine rotates.

The time dt elapsing between two successive fluid pistons depends in particular on the rotational speed of the turbine. Thus, when the rotational speed is uniform, the time dt separating emission of two liquid pistons is essentially constant.

If a rotational speed that varies over time is chosen, namely one that can accelerate or decelerate, then the time intervals dt separating two pistons can be completely different.

It is also possible to cause length l of the fluid pistons to vary, this length being a function in particular of the geometries and sizes of orifices Ei located on the distributing part.

The drive fluid flow is preferably distributed to orifices Ei in order to minimize surges. Such a result is achieved for example by choosing a constant number of orifices Ei and identical sections for the orifices. Rotation of the slide keeps the passage cross sections of orifices Ei substantially constant.

The slide can be of unit length, for example, or formed by several segments, the latter embodiment allowing dynamic balancing of the device.

For each distributing part, it is possible to determine in classical fashion the characteristic curves such as the relative pressure gain M defined by $$\rho = \frac{Pdis - Psuc}{Pdri - Pdis}$$

as a function of the entrainment rate determined by the ratio N between the intake flow Qint and the drive flow Qdri, the energy yield p for the liquids (drive and intake) then being equal to M*N.

The discharge pressure Pdis and intake pressure Pint, the drive fluid pressure Pmot, the drive flow Qdri, and the intake flow Qint are for example measured by appropriate devices known to the individual skilled in the art.

According to one advantageous embodiment of the device (FIG. 2), a reaction turbine is used as the movable part.

Static hollow part 2 of the device is extended at one end by a part 13*a* having at least one orifice Oi, the diameter of part 13*a* being less than that of part 2. Part 13*a* serves for example as an axis of rotation for a reaction turbine 14, which can be moved by bearings 15 such as fluid bearings which minimize friction and wear of parts 13*a* and 14.

Reaction turbine 14 has for example at one of its ends a slide 7 which, identically to that described in relation to FIG. 1, blocks orifices Ei of a distributing part 17 located substantially coaxially with respect to static hollow part 2, and maintained with respect to the latter by means of a connecting part 5 which also ensures a seal between parts 2, 17 in order to prevent primary fluid, which might contain impurities, from contacting turbine 14.

The device is positioned in pipe 1 such that the part containing distributing part 17 penetrates at least partially into a part 19 whose inside wall 19' is preferably designed to create a passage Pr with a smaller cross section than that of pipe 1. This decrease in cross section creates a suction effect which favors mixing and transfer of energy between the liquid pistons and the primary fluid to be transported, before transfer to a divergent section 33 formed for example by a part 34 located downstream of part 19. The specific role of the divergent section is to allow speed energy to be converted into pressure energy.

The liquid pistons are generated according to a principle substantially identical to that described in relation to FIG. 1.

The drive fluid passes from inside static hollow part 2 thorough orifices Oi into an annular chamber 32, then leaves through channels 31 via orifices 30. The drive fluid has sufficient power for its passage through orifices 31 to generate a drive torque which in particular causes rotation of reaction turbine 14.

Figure 2:
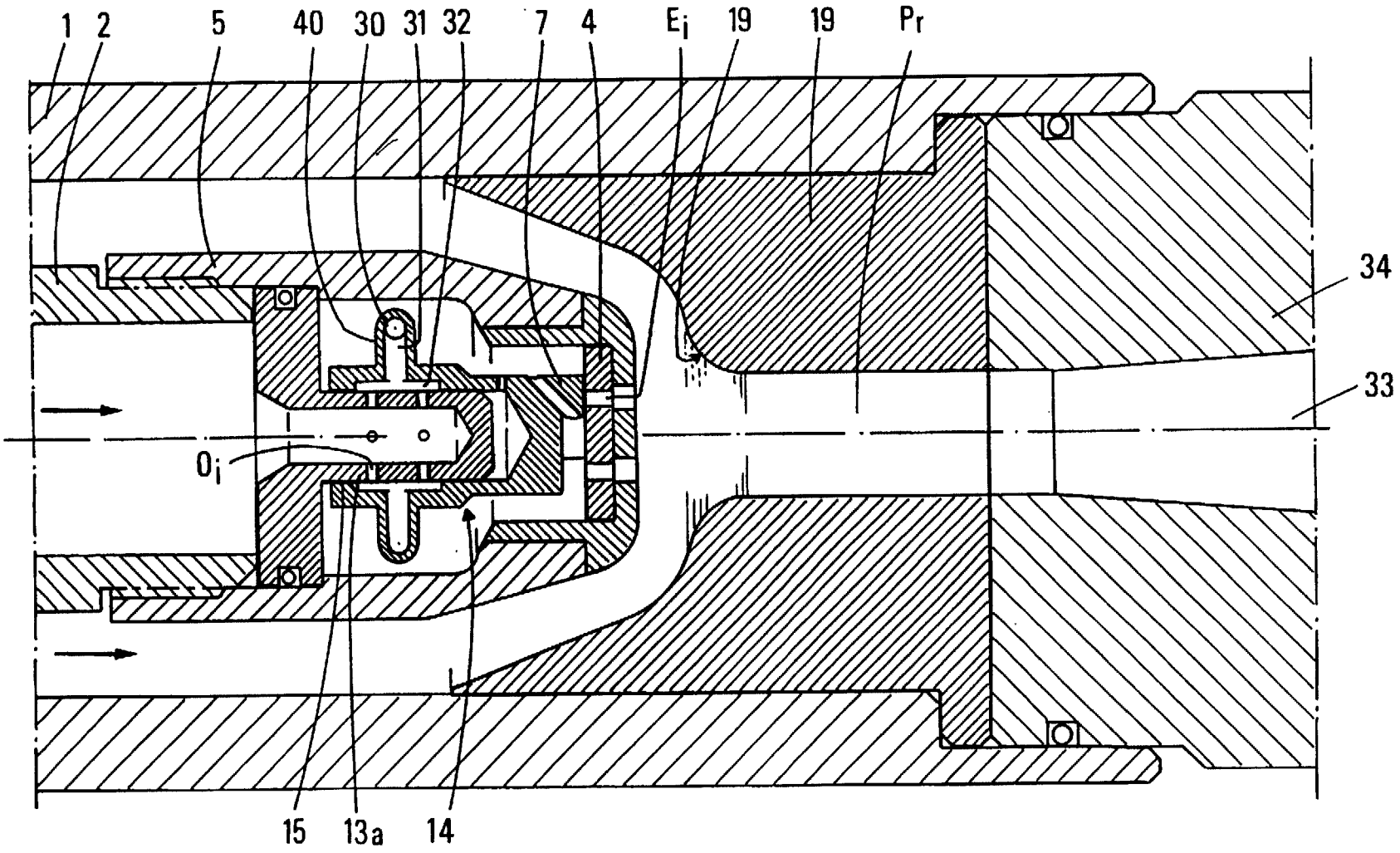
FIGS. 2, 2B, 2C, 2D, and 2E show schematically another variant of the device and the ejection cycles of the associated jets.
Figure 2C:
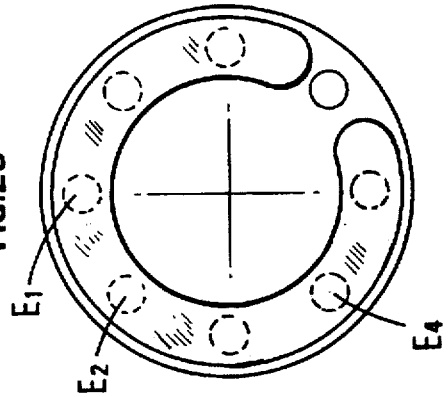
Figure 2B:
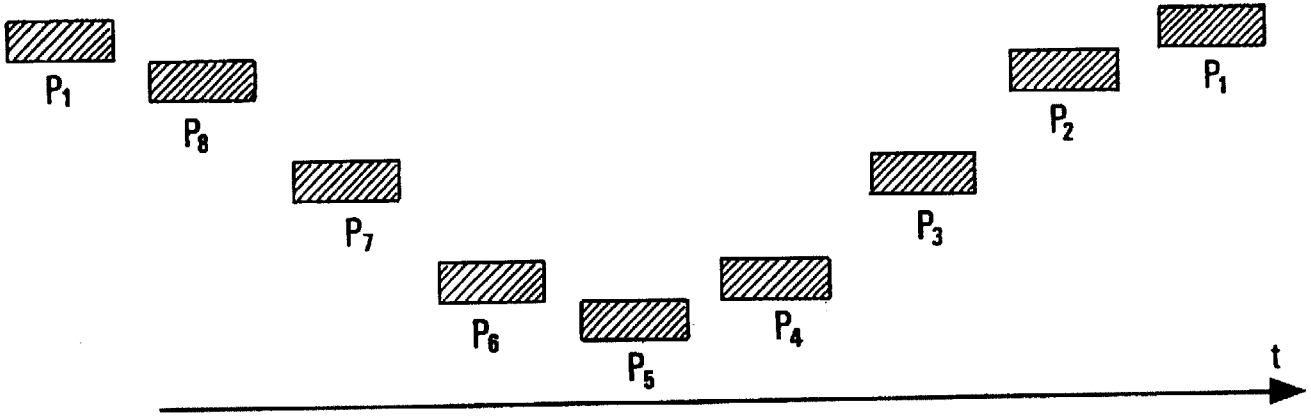

FIG. 2B shows a possible generation sequence of liquid pistons from orifices Ei.

The distributing part (FIG. 2C) has for example 8 orifices E1, . . . Ei, . . . E8 distributed for example uniformly with respect to each other, namely with the distances separating them being substantially equal. The liquid pistons P1, . . . Pi, . . . P8, P1 generated when the drive fluid passes through these orifices Ei are sent for example intermittently at sequential time intervals one after the other. The distribution of the liquid pistons results particularly from the frequency with which the fluid pistons are sent and in the distribution of the orifices on the distributing part. Thus, the liquid pistons distribute throughout the pipe in such a way as to touch practically all of the primary fluid and transfer to said fluid sufficient energy for it to be transferred from one location to another.

As indicated above, the time interval separating the liquid pistons is specifically a function of the rotational speed of the turbine.

The length of a liquid piston is defined for example by the geometry and size of orifices Ei of the distributing part, identically to FIGS. 1A to 1C.

Figure 2E:
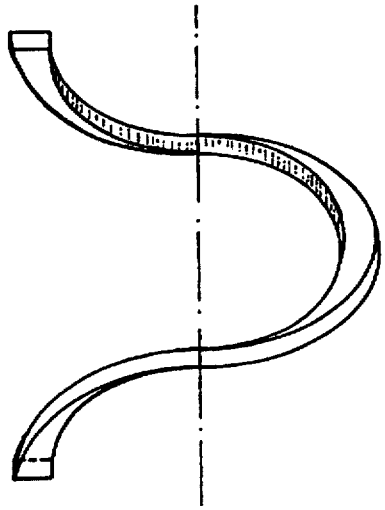
Figure 2D:
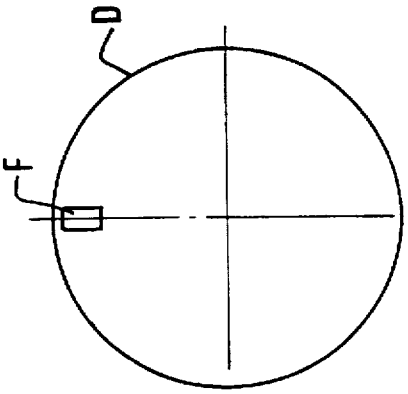

In another embodiment of the invention, the liquid pistons are generated in the manner described below. The term "intermittent" relates more precisely in this case to the way in which the liquid pistons come in contact with a given location in the primary fluid. Thus it is possible to generate a first liquid piston, namely it transmits energy to part of the primary fluid located relative to a given location in the pipe, then to a second part of the fluid located for example near the first part of the fluid previously brought into contact with the first liquid piston, and so forth until the majority of the primary fluid to be transported circulating in the pipe is brought into contact with a succession of liquid pistons enabling its transfer. Part of the primary fluid is thus brought into contact intermittently with a liquid piston. Preferably, the liquid pistons are generated so that they are close enough in space for the majority of the primary fluid to acquire at least part of the energy coming from the drive fluid and for the succession of these pistons to form a fluid piston that has a substantially helical shape (FIG. 2E) that progresses as time goes on in the pipe, entraining the primary fluid.

For this purpose, the distributing part has a circular slot which is blocked for example by a means such as a part D having an orifice F, the surface area and dimensions of this part being chosen to allow the drive fluid to pass only through this orifice. Because of the rotation of the distributing part and the single slot, passage of the drive fluid through orifice 20 occurs for example in the form of a succession of liquid pistons that are sufficiently close to each other to form a helically shaped liquid piston.

Such a piston advantageously replaces the mechanical helical blades of the usual pumping devices by fulfilling a substantially identical function; for example it replaces screw pumps of the Archimedes screw type.

In this embodiment, the liquid piston has the advantage of being substantially axial in the main, and not rotary. The centrifugal effect resulting from this axiality avoids segregation of the mixture composed of the drive and primary fluids, which segregation results particularly from the centrifugal effect associated with the rotary jets created by the rotating blades. Such behavior is similar to the behavior obtained with volumetric pumps of the Archimedes screw type.

To minimize friction of the slide on the distributing part or plate containing the orifices and to decrease the energy picked up that is necessary to cause the slide to rotate, it is possible to decrease the contact surfaces existing between the rotational axis of the turbine and the other parts. Direct friction between the blocking slide and the distributing plate is eliminated by using an axial pivot which may have a means for taking up the play, said pivot being self-lubricating for example.

Figure 3:
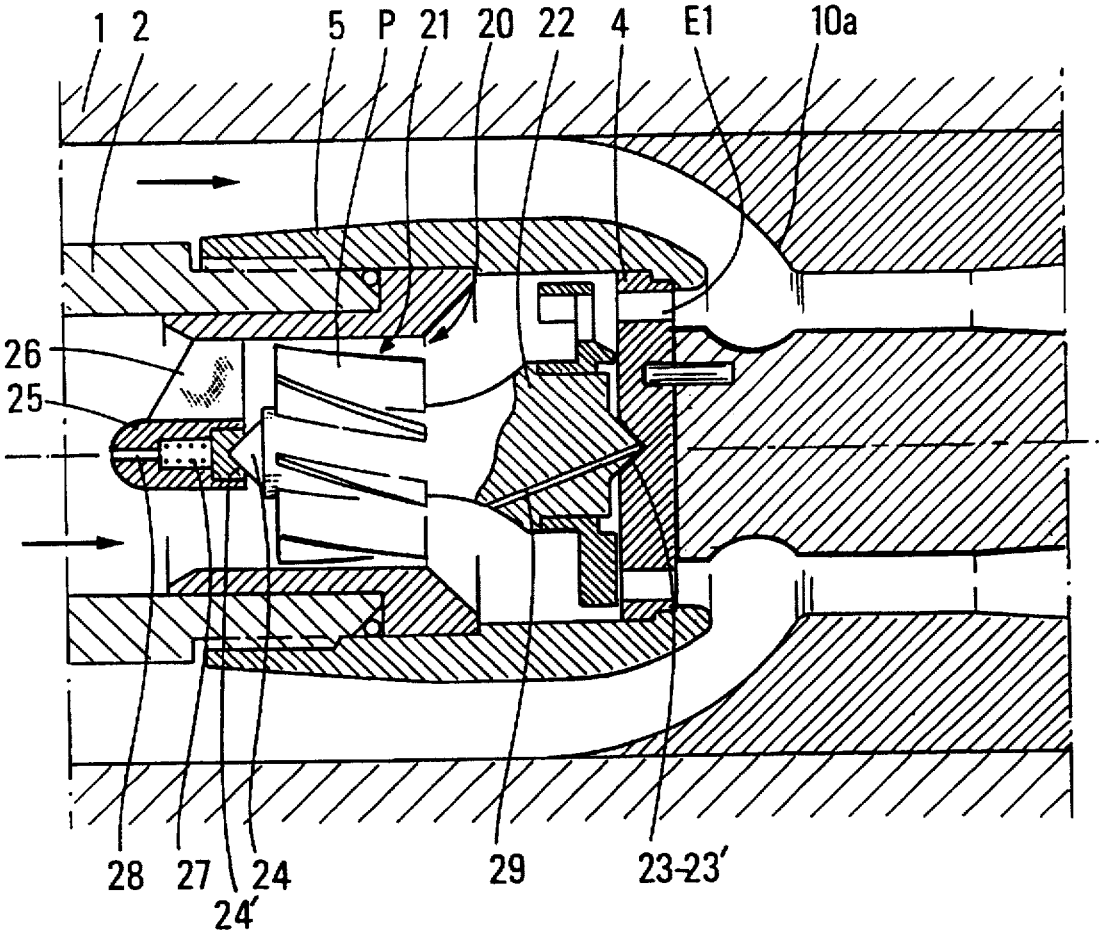
FIGS. 3 and 4 show device variants for which direct friction is minimized by using an axial pivot.
Figure 4:
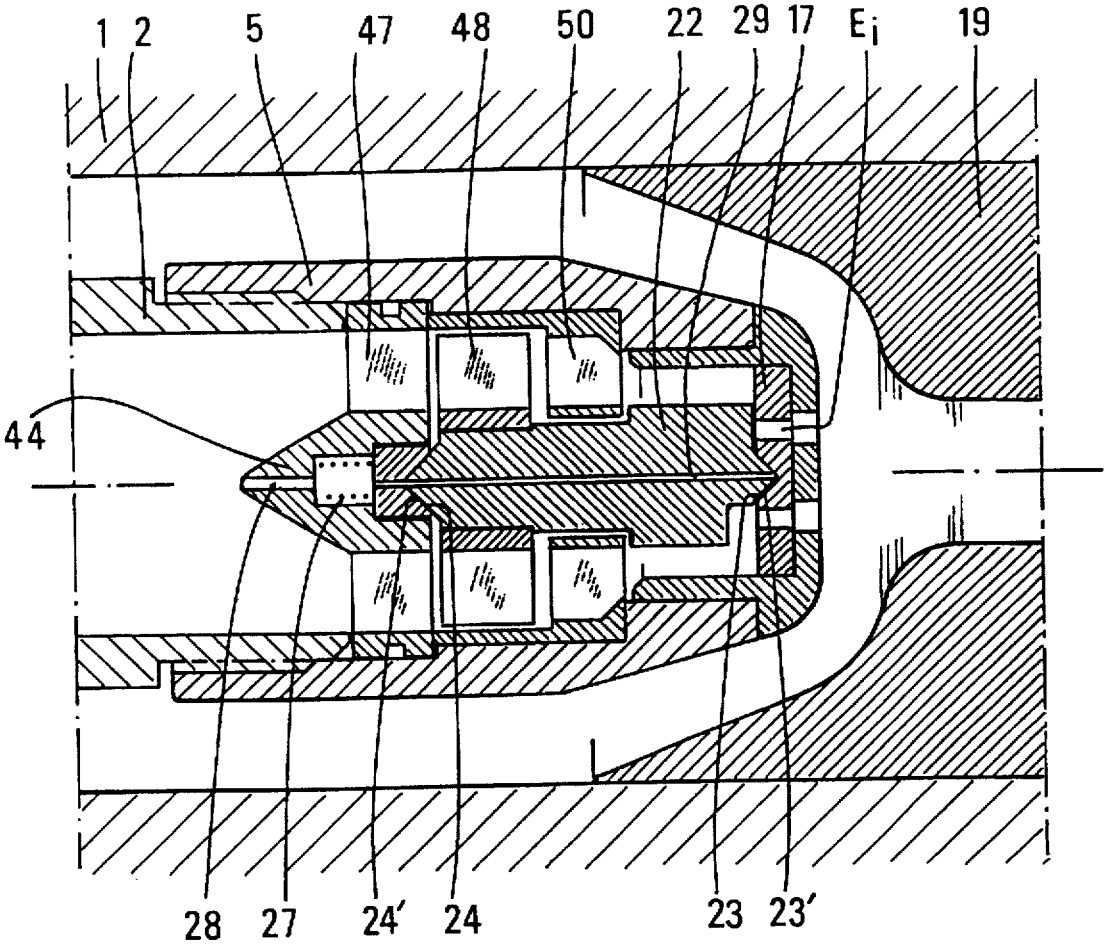

FIGS. 3 and 4 described hereinabove show schematically the variants of the devices described above.

FIG. 3 represents a variant of the device differing from FIG. 1 involving particularly the shape of static part 2 and especially its end, and of movable part 6.

Static part 2 is open at both ends; the T-shaped part of FIG. 1 is replaced by an opening 20 into which is inserted an assembly comprising in particular a turbine 21 similar for example to that of FIG. 1A. A turbine of the "paddlewheel" type normally used for flowmeter measurements made on fluids known as "clean fluids" such as particle-free fluids can be used. The assembly is positioned in the space formed by static part 2, connecting and sealing part 5, and distributing plate 4 (FIG. 1).

This assembly has for example turbine 21 comprising a part 22 terminating at each of its ends in tips, 23 and 24 respectively. Tip 23 fits into a space 23' provided in distributing part 4 and part 24 into a space 24' of a part 25 integral for example with static hollow part 2 through means 26 such as holding arms. The number of holding arms is three for example. The axis of turbine 20 is located for example substantially in the axis of the distributing part. The presence of tips allowing holding and rotation of the turbine reduces the torques and friction between parts.

Part 25 has for example a return means 27 such as a spring to take up any play resulting from wear of the tips over time.

In order to cut down considerably on friction between the various parts, a pipe 28 passes through part 25 for example and allows at least a fraction of the drive fluid coming from inside hollow part 2 to pass through, said fluid fraction thus forming a lubricating film between tip 24 and its accommodation 24'. The same applies to tip 23 which can be lubricated by forming a film over its surface obtained by passage of at least one part of the drive fluid through a pipe 29.

Turbine 21 has a series of blades P, each of which is preferably at an angle to the turbine axis. Identically to FIG. 1, the turbine is provided at least with a means allowing blocking of orifices Ei of distributing part 4, such as a slide 7, positioned relative to part 4 in such a way as to minimize the play between the distributing part and the slide. The small existing space thus allows the fraction of drive fluid to pass, thus ensuring lubrication of the two parts and cutting down friction.

The turbine is made to rotate in a manner identical to that described in FIG. 1, for example.

According to one advantageous embodiment shown schematically in FIG. 4, reaction turbine 14 and the associated slide of FIG. 2 are replaced by an assembly minimizing the friction forces, designed on a principle identical to that described in FIG. 3, namely having a shape that minimizes the contact surfaces between parts.

To optimize passage of drive fluid through orifices Ei of the distributing part, turbine 49 can have a static blade controller 50 whose particular function is advantageously to transform the drive fluid into coaxial flow.

The drive fluid from the static hollow part strikes blades 48 of a turbine 49 positioned around part 22 and causes it to rotate. The rotational speed of the turbine is chosen for example as a function of the attack and trailing angles of blades 48. A static blade controller 50 located substantially coaxially with respect to turbine 49 allows the drive fluid to be regulated, changing it into coaxial flow. The drive fluid thus arrives in a direction that is substantially coaxial with the axis of the turbine at orifices Ei, and any impacts between the fluid and the walls of the orifices and/or the distributing part are thus minimized. Transfer of drive fluid in the form of jets to the primary fluid to be pumped is thereby optimized.

In this embodiment, pipe 29 (FIG. 2) can be situated according to the axis of part 22, for example over the entire length of this part, and can be in communication with pipe 28.

The drive fluid is for example a pressurized liquid coming from an external source.

According to one advantageous embodiment of the invention, the drive fluid is for example a fluid miscible with the fluid to be pumped. For a pumped fluid with a high viscosity, such mixing allows this viscosity to be decreased, favoring pumping and transport of such a fluid over long distances.

The fluid can also include products or additives such as rustproofers, inhibitors of hydrates allowing formation of deposits, and additives to counteract flocculation or precipitation of the fluids to be pumped.

These products are well known for example to experts in the oil industry.

Without departing from the framework of the invention, this fluid can also be oil or water coming for example from the field being produced.

It can also be sea water.

In both cases, the fluids are taken from a spring or the sea with a device not shown in the figures and conveyed to the static hollow part through a pipe. When such fluids are used, it is preferable to have, downstream of the orifices Oi allowing this water to pass to the movable part, a device allowing any particles contained in such water to be retained, such as a filter in normal use and of a size such as to retain any particles contained in the fluid.

For fluids from a spring at an inadequate pressure, it is possible to position a device raising the pressure of these fluids so that they can play the role of a drive fluid.

The shapes of the orifices of the distributing part are chosen according to the length of the desired liquid piston. Thus, these openings can be circular, elongate, or slot-shaped.

In order to stay at constant average motive power, each diameter of a nozzle is preferably apposed to a distributing part to preserve an instant flowrate of the drive liquid in the incoming drive fluid pipe.

The rotational speed of the sequential jet-creation device, namely the distributing part, is for example between 0 and 3000 revolutions per minute.

The drive fluid is for example ejected with a number of jets such that it favors the efficiency of the device.

When the drive liquid is made to contact the slide, this favors formation of a fluid film under the slide which minimizes friction between the blocked-off section and the slide. In this way, the energy necessary for the sequential blocking function is low.

The contact force between the movable part and the distribution and holding parts can also be reduced by using turbine blades that have an angle of inclination chosen relative to the internal jet.

In the case of reaction turbines, the propulsive jets are at an angle; counterreaction blades can also be used.

When the drive liquid is made to contact the slide, this favors formation of a fluid film under the slide which minimizes friction between the blocked-off section and the slide. In this way, the energy necessary for the sequential blocking function is low.

This contact force can also be reduced by using turbine blades that have an angle of inclination chosen relative to the direction of the drive fluid coming from inside the static hollow part.

In the case of reaction turbines, this consists of inclining the propulsive jets or counterreaction blades.

The movable part such as the action turbine, reaction turbine, or any type of turbine can be made to rotate by a device, not shown, that allows at least part of the drive fluid to be sent preferably directly to the orifices of the distributing part.

The devices described above in relation to the figures can be positioned at the end of a piece of coil tubing, a technique being used increasingly for production of vertical wells as well as for horizontal drains.

I claim:

1. Pumping device by direct energy exchange between a drive fluid and a primary fluid having, in combination, a static hollow part allowing said drive fluid to pass, said static hollow part having an opening, a distributing part having at least one orifice, said distributing part being situated with respect to the static hollow part such as to allow the drive fluid to pass from said opening of the static hollow part to an orifice of the distributing part, the distributing part and the static part being joined by a connecting and sealing part, a movable part disposed in the space formed by the static hollow part, the distributing part, and the connecting part, said movable part having at least one means for blocking orifices of the distributing part such that at least part of said drive fluid is ejected intermittently to the primary fluid when movable part rotates.

2. Device according to claim 6 characterized in that orifices have geometric characteristics such that the lengths of the jets exiting orifices Ei have substantially identical shapes and lengths.

3. Device according to claim 2 characterized in that moving part is a turbine such as an action or a reaction turbine, made to rotate by the drive fluid.

4. Device according to claim 1 characterized by having a part located in the extension of the distribution part and aligned with the latter by means, the part having at least one opening creating at least one mixing space.

5. Device according to claim 1 characterized in that the orifices of the distributing part are constituted by a single circular slot and in that the slot-blocking means comprise an orifice.

6. Device according to claim 1, wherein said movable part comprises a turbine and said at least one means for blocking orifices comprises a slide provided at a downstream end of and rotating with said turbine for blocking orifices of the distributing part such that at least part of said drive fluid is ejected intermittently to the primary fluid when said turbine rotates.

7. Device according to claim 6, wherein said turbine terminates at each of its upstream and downstream ends in a tip, the tip at said upstream end fitting into a correspondingly shaped space in a holding part connected to said static hollow part, and the tip at said downstream end fitting into a correspondingly shaped space in said distributing part.

8. Device according to claim 5, wherein said holding part includes a passage extending therethrough and terminating at said space in which the tip at said upstream end of said turbine is fitted for allowing at least a fraction of the drive fluid to pass to through to form a lubrication film between the tip and the space.

9. Devise according to claim 7, wherein said turbine has a passage extending through at least a portion thereof and terminating at the tip at said downstream end for allowing at least a fraction of the drive fluid to pass through to form a lubricating film between the tip and the space provided in said distributing part.

10. Device according to claim 6, wherein said turbine has a passage extending through at least a portion thereof and terminating at the tip at said downstream end for allowing at least a fraction of the drive fluid to pass through to form a lubricating film between the tip and the space provided in said distributing part.

* * * * *